United States Patent [19]

Negosta

[11] 4,243,158

[45] Jan. 6, 1981

[54] GRANULAR PRODUCT DISPENSER

[76] Inventor: Edward W. Negosta, 4803 Old Branch Ave., Camp Springs, Md. 20031

[21] Appl. No.: 14,258

[22] Filed: Feb. 22, 1979

[51] Int. Cl.[3] ..... B67D 5/38

[52] U.S. Cl. ..... 222/184; 222/564

[58] Field of Search ..... 222/184, 185, 561, 181, 222/83, 83.5, 564, 158

[56] References Cited

U.S. PATENT DOCUMENTS

| | | | |
|---|---|---|---|
| 2,775,270 | 12/1956 | McKillop, Jr. | 222/185 X |
| 2,782,011 | 2/1957 | Fitzgerald | 222/185 X |
| 3,344,958 | 10/1967 | Kaanehe | 222/181 |

*Primary Examiner*—Stanley H. Tollberg
*Attorney, Agent, or Firm*—Lawrence Harbin

[57] ABSTRACT

A granular product dispenser for containing an original package and dispensing the contents thereof consisting of a package receiving portion, a base including a utility shelf, and a funnel portion having an oblique shape which permits dry granular material to readily flow freely without clogging at its discharge port. The funnel also includes baffles to further disperse the granular product, and a discharge port and gate valve assembly thereat wherein the shape of the discharge port and the opening of the gate valve are similar to the shape of the funnel mouth. Adaptors are also provided so that the unit may accomodate original packages of different sizes.

8 Claims, 9 Drawing Figures

FIG. 2a
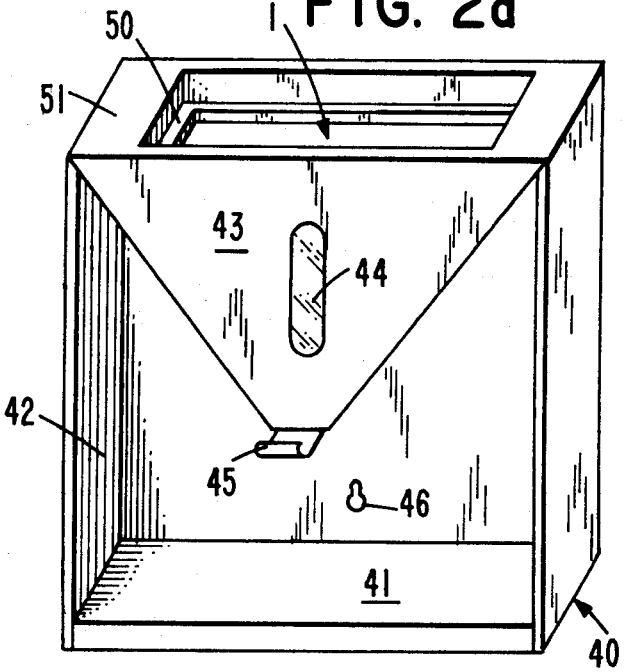
FIG. 2b
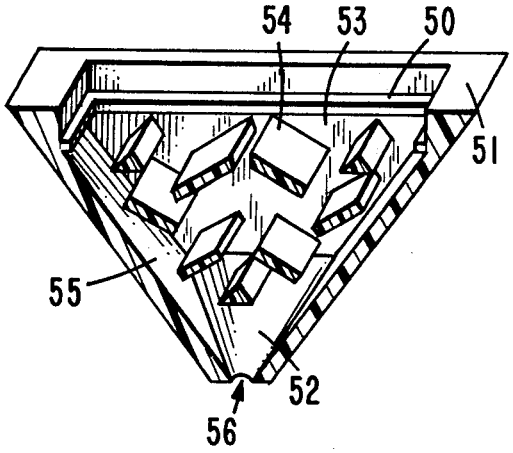
FIG. 3a
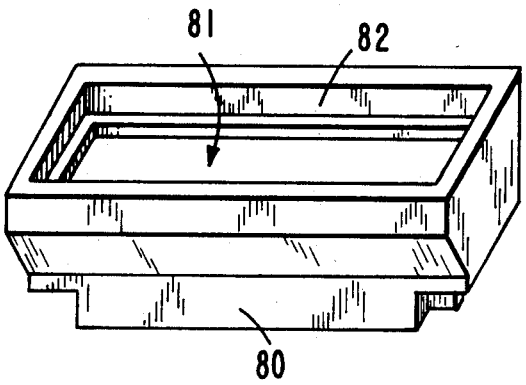
FIG. 3b
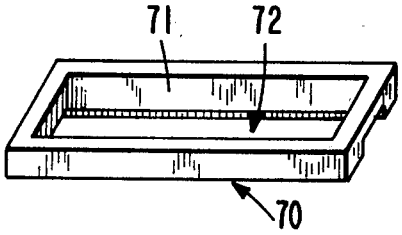
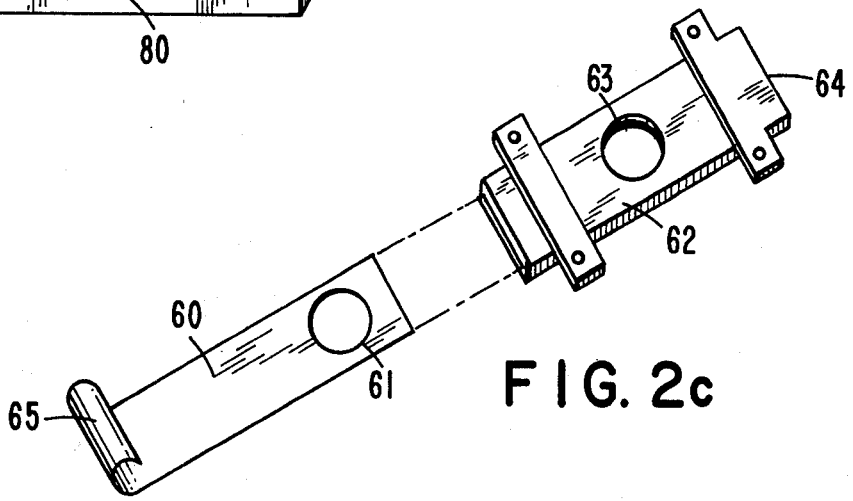
FIG. 2c

GRANULAR PRODUCT DISPENSER

BACKGROUND OF THE INVENTION

The invention relates to the art of dry product or granular dispensers, such as laundry detergent dispensers. Of particular concern is the efficacy with which such powders flow from such dispensers without clogging or stopping up the dispenser chute.

In that regard, this invention more particularly relates to free-flowing dry product dispensers.

Dry products, such as soap powders, are usually purchased in rigid container boxes. Small quantities of the dry product are taken from the container by various means, such as scoops for the large boxes, or are poured from the smaller boxes into other containers. Sometimes, it is rather inconvenient to handle the dry product in this manner, and consequently, a dispenser is often employed. The dispensers most often employed, for house-hold purposes, generally do not provide means for the user to visually observe the quantity of product remaining in the dispenser, and usually do not provide means to disperse the dry product which oftentimes will have previously solidified in its container because of moisture. Additionally, present dispenser devices are not readily adaptive to receive boxes of different sizes. Above all, there has been no consideration in prior art dispensing devices given to what optimum geometrical shape of the hopper renders the best flow characteristics for dry products.

One such prior art device is disclosed in U.S. Pat. No. 3,344,958, issued to Kaanehe on Oct. 3, 1967, wherein a soap box dispenser is disclosed most similar to the subject invention. Dispersion baffles for dry products are shown in U.S. Pat. Nos. 1,845,847, and 2,907,501, issued to Reuther and Laird, respectively. Neither of these inventions take into account static pressures produced by the weight of the granules about the discharge port, nor do they provide means whereby different size containers may be accomodated, if dispensing is to be performed from original packages.

In view of the foregoing, it is the primary objective of the invention to provide a dry product dispenser having free-flowing characteristics for granular material.

It is a second objective of the invention to provide a dispenser which can be adapted to receive rigid containers of various sizes.

It is a third objective of the invention to provide a dry product dispenser with window means to observe the quantity of dry product remaining within the dispenser.

Further objects of the invention will become more readily apparent upon review of the disclosure herein to follow.

SUMMARY OF THE INVENTION

The preferred embodiment of the invention comprises three basic elements, that is, a package receiving portion, an oblique funnel having a discharge port and a gate valve assembly at its mouth, and a supporting base including therewith a utility shelf below the discharge port of the funnel. Each of the three basic elements is designed to accomplish the objective to the invention.

The package receiving portion, again in the preferred embodiment, has a series of relatively small stops at the top portion thereof for either supporting a soap box or the like, or an adaptor for adapting the dispenser unit to a box of a different size. The adaptor also has a series of stops for supporting soap boxes of the like. A series of stops are employed, instead of a lip or ledge, for the purpose of eliminating a surface ledge upon which granules can accumulate about the receiving opening, thus assuring unobstructed insertion of packages.

The oblique funnel, instead of a symetrical funnel, is employed for the purpose of preventing static pressure buildup of the granules within the funnel, thereby enhancing the free-flow characteristics of the dry product dispenser. The specific design of the oblique funnel is such that the mouth of the funnel is not in axial alignment with the axis of the funnel. When the mouth is offset from the center, static pressures which normally develope, are substantially reduced. In a symetrical funnel having a centered discharge port, pressures develop laterally, as well as vertically, about the discharge port. These lateral forces cause the grains to bind, thus reducing the free-flowing ability of the dry granules. A funnel having an off-centered discharge port, as does the subject invention, substantially reduces the static pressure buildup about the discharge port.

To further reduce the static pressure buildup, and to break up any possible solidification of the granular product, baffles have been disposed in the funnel. Baffles also help remove some of the weight off the granules at the discharge port. As an additional novel feature, a transparent window has been placed on the surface of the funnel so that the user may visually observe quantity of dry product remaining in the hopper of the funnel.

More importantly though, is the shape of the discharge port at the funnel mouth and the shape of the opening of the gate valve. For minimum obstruction to granular flow, the shape of the funnel mouth, discharge port, and opening of the gate value should be identical or substantially the same.

The third basic element of the dispensing unit consists of a supporting base for supporting the package receptor and the funnel. A utility shelf is integrated with the supporting base below the gate valve assembly for placement of a cup or container. The supporting base may also be equipped with mounting brackets for wall mounting.

BRIEF DESCRIPTION OF THE DRAWINGS

FIG. 1 (*b*) shows a side view of the preferred embodiment.

FIG. 1 (*c*) shows a top view of the preferred embodiment.

FIG. 1 (*d*) discloses the details of the gate valve assembly of one embodiment of the invention.

FIG. 2 (*a*) discloses a second embodiment of the invention having a different baffles arrangement and discharge port design.

FIG. 2 (*b*) shows a cross sectional view of the funnel of FIG. 2 (*a*).

FIG. 2 (*c*) discloses another form of the gate valve assembly adapted for the funnel of FIG. 2 (*b*).

FIG. 3 (*a*) shows an adaptor for the dispenser unit.

FIG. 3 (*b*) shows another adaptor for the dispenser unit.

BRIEF DESCRIPTION OF THE INVENTION

Figure 1A:
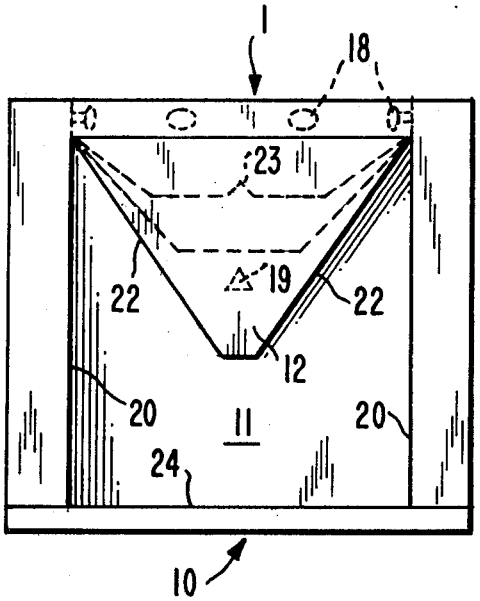
FIG. 1 (*a*) shows a front view of the dispenser unit in the preferred embodiment.
Figure 1B:
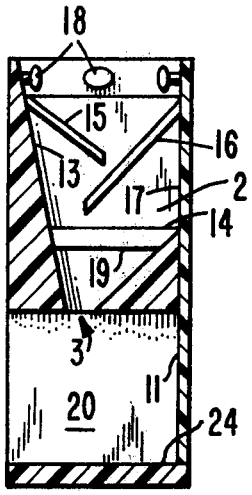
Figure 1C:
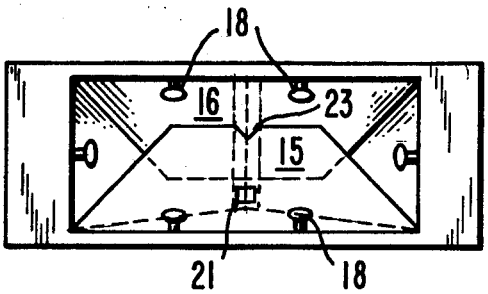
Figure 1D:
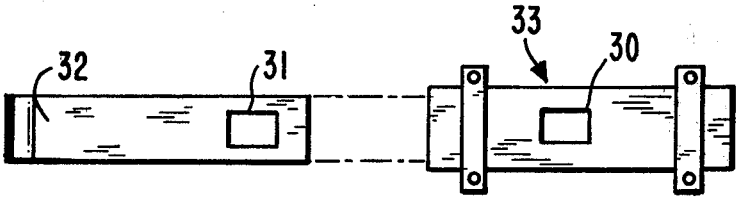

For purposes of functional description of the entire unit, reference is made to all diagrams of FIG. 1. Cavity 2 of FIG. 1 (*b*) is specially designed in the shape of an oblique cone wherein hole 3 is not in alignment with the axis of the cone and not equidistant between the front and back walls 13 and 14. This misalignment reduces the static pressures upon the dry granules about hole 3 and thus provides substantially less resistance to the flow ability of the granules. In the preferred embodiment of the invention, cavity 2 is defined by vertical wall 17, inwardly slanting wall 14 in the rear of cavity 2, inwardly slanting wall 13 in the front of cavity 2. The aforementioned walls converge at mouth 3 of the funnel to form a discharge port in which the gate valve assembly of FIG. 1 (*d*) is disposed.

Now, referring to FIG. 1 (*a*), a front view of the dispensing unit is shown wherein area 1 designates the general area where an original container (not shown) is placed in an inverted position. The contents of the container empties into funnel 12 and is dispersed by baffles 15, 16, and 19, depicted in FIG. 1 (*b*). Pins 18 of FIG. 1 (*b*) provide stops for the original container and are relatively small to prevent accumulation of excess granules around the opening of area 1.

FIG. 1 (*d*) shows details of a gate valve assembly which is disposed at the mouth of funnel 12 when assembled.

With specific reference to the gate valve assembly of FIG. 1 (*d*), element 32 is adapted to slide into element 33, and when element 32 is moved to a position where hole 31 is in alignment with hole 30, granular material will flow from funnel 12. It is important to note that the shape of holes 31 and 30 is identical to the shape of the discharge port 3 of funnel 12. In an effort to further reduce flow obstruction, it has been found that continuity of direction of granular flow produces optimum flow characteristics. In FIG. 1 (*d*), a square hole has been illustrated, however, it should be noted that any shape will suffice for optimum free flowing characteristics, such as a round hole, so long as the shapes are uniform. The preferred embodiment has either a square or round hole.

Specific reference to FIG. 1 (*c*) will illustrate the package receiving portion of the dispensing unit. Pins 18 are disposed around inside of the opening 1 to support the weight of the container. It has been found that small pins, instead of a ledge, prevent pile-up of spilled granules which may block the normal insertion of the original packages. It is unlikely that granules, such as soap powders, will accumulate or solidify upon the pins.

Also shown in FIG. 1 (*a*) is shelf 24 providing convenient means to load containers below the discharge port. Shelf 24 may be integrated with the entire structure, or it may be an attachment. The entire unit may be an integrated structure, or it may be composed of subassemblies.

Of importance is the design and location of baffles 15 and 16 of FIG. 1 (*b*). Again, in the preferred embodiment, two baffles are employed. Specifically, baffle 15 protrudes into cavity 2 from the top of the cavity, slanting inwardly and allowing a space between its edge and cavity walls 22. Likewise, baffle 16 protrudes into cavity 2 from the opposed edge of the top of cavity 2 and extends inwardly under the lower edge of baffle 15 in a manner so as to provide a zig-zag path of granular flow.

Now, referring to FIGS. 2 (*a*), 2 (*b*), and 2 (*c*), a second embodiment of the invention is disclosed wherein view 44 is shown on face 42 of the funnel. Viewer 44 is a transparent window and provides the means for one to observe the quantity of granular material remaining in the funnel. Additionally, the dispenser unit is shown to have a ledge 50 in opening 1 as an alternative, but not desireable, means to support the original package (again not shown) in an inverted position. In all other respects, the main frame of the unit of FIG. 2 is substantially similar to the main frame of the dispenser unit shown in FIG. 1, except the baffle design and the shape of the hole in the discharge port.

Specific reference to FIG. 2 (*b*) shows a multitude of baffles 54 disclosed in the cavity of the funnel for dispersion of the granular material. Convergence of the side walls 55 and 52 is made in a circular discharge port 56, which corresponds to the shape of the holes in the gate valve assembly shown in FIG. 2 (*c*). The operation of the gate valve assembly of FIG. 2 is the same of that shown in FIG. 1.

Referring now to FIG. 3 of the drawings, adaptors are shown which fit into opening 1 of the dispensing unit of FIGS. 1 and 2. The adaptors are designed to fit standard size boxes now in the industry for dry products, such as laundry detergents. The bottom of the adaptors on FIGS. 3 (*a*) and 3 (*b*) are sized to fit the dispensing units. The top portions of the adaptors are sized to fit dry product containers of a different size than that which the dispensing unit is sized.

The embodiment shown in the invention is to be considered in all respects as illustrative and not restrictive, the scope of the invention being indicated by the appended claims rather than by the foregoing description and all changes which some within the meaning and range of the equivalency of the claims are therefore intended to be embraced therein.

Now, therefore, a brief description having been made, what is claimed is:

1. A combined holder and dispenser for dispensing granular products from their original package comprising:

a rectangular package receiving portion said package receiving portion including adaptor means for adapting said package receiving portion to receive an original package of a different size, a funnel portion connected to said rectangular package receiving portion, said funnel portion including a discharge port and a gate valve assembly at the mouth thereof for controlling the discharge of granular products, and a supporting base for supporting said receiving portion and said funnel portion, said base including a shelf disposed below said valve assembly for supporting a granular product receiving cup.

2. The invention of claim 1 wherein said funnel portion contains therein multiple baffles for dispersing the granular products.

3. The invention of claim 1 wherein said funnel portion includes a transparent window for permitting visual observation of the quantity of granular product within said funnel portion.

4. The invention of claim 1, wherein the package receiving end of said rectangular package receiving portion includes a plurality of small stop means for supporting the original package.

5. The invention of claim 1 wherein the shape of the discharge port and the valve assembly opening conforms to shape of the opening of the mouth of said funnel portion.

6. A combined holder and dispenser for dispensing granular products from their original package comprising: a rectangular package receiving portion, said receiving portion including at the top portion thereof a series of relatively small stops for supporting the original package; a funnel portion disposed immediately below said rectangular package receiving portion, said funnel portion having a discharge port and a gate valve assembly at the mouth thereof, at least one baffle within said funnel for dispersing the granular products, and a transparent window for permitting visual observation of the quantity of granular products within said funnel portion; and a supporting base for supporting said package receiving portion and funnel portion, said supporting base including a shelf disposed below said valve assembly for supporting a granular product receiving cup.

7. The invention of claim 6 including an adaptor for adapting said rectangular package receiving portion to receive an original package of a different size, said adaptor being adapted to fit into said rectangular package receiving portion.

8. The invention of claim 6 wherein the shape of the discharge port and the valve assembly opening conforms to the shape of the opening of the mouth of said funnel portion.

* * * * *